US012257617B2

(12) United States Patent
Chu et al.

(10) Patent No.: US 12,257,617 B2
(45) Date of Patent: Mar. 25, 2025

(54) PREFORMING METHOD FOR HIGH-STRENGTH STEEL VARIABLE-DIAMETER TUBULAR PART

(71) Applicants: Guannan Chu, Weihai (CN); HARBIN INSTITUTE OF TECHNOLOGY, WEIHAI, Weihai (CN)

(72) Inventors: Guannan Chu, Weihai (CN); Lei Sun, Weihai (CN); Wencai Xie, Weihai (CN); Cunsheng Zhang, Weihai (CN); Anying Yuan, Weihai (CN); Gang Fang, Weihai (CN); Qin Yang, Weihai (CN)

(73) Assignees: Guannan Chu, Weihai (CN); HARBIN INSTITUTE OF TECHNOLOGY, WEIHAI, Weihai (CN)

( * ) Notice: Subject to any disclaimer, the term of this patent is extended or adjusted under 35 U.S.C. 154(b) by 389 days.

(21) Appl. No.: 17/876,184

(22) Filed: Jul. 28, 2022

(65) Prior Publication Data

US 2023/0278091 A1 Sep. 7, 2023

(30) Foreign Application Priority Data

Mar. 1, 2022 (CN) ..... 202210195399.8

(51) Int. Cl.

| | |
|---|---|
| ***B21D 26/047*** | (2011.01) |
| ***B21D 26/053*** | (2011.01) |
| ***B21D 37/16*** | (2006.01) |

(52) U.S. Cl.

CPC ..... *B21D 26/047* (2013.01); *B21D 26/053* (2013.01); *B21D 37/16* (2013.01)

(58) Field of Classification Search

CPC .. B21D 26/033; B21D 26/035; B21D 26/041; B21D 26/047; B21D 26/053; B21D 37/16

See application file for complete search history.

(56) References Cited

U.S. PATENT DOCUMENTS

| | | | | |
|---|---|---|---|---|
| 3,487,668 A * | 1/1970 | Fuchs, Jr. | ..... | B21D 26/035 72/58 |
| 7,191,032 B2 * | 3/2007 | MacEwen | ..... | B21D 26/041 72/58 |
| 2017/0266710 A1 * | 9/2017 | Ishizuka | ..... | B21D 26/047 |

* cited by examiner

*Primary Examiner* — Teresa M Ekiert

(57) ABSTRACT

A preforming method for a high-strength steel variable-diameter tubular part is provided, which belongs to the technical field of metal forming process. The preforming method for a high-strength steel variable-diameter tubular part includes: selecting a tubular blank; and preparing a tubular blank forming mold, where the tubular blank forming mold includes a preforming mold and a final forming mold; sealing and pressurizing the tubular blank; heating the tubular blank by using electrodes; preforming the tubular part at a constant temperature; maintaining a temperature Tl and moving the preformed tubular part to the final forming mold; finally forming the tubular part. Through two steps of operation of preforming and final forming, and maintaining a temperature during moving the tubular blank between the two steps, so that the conversion of intrametallic structure between the two steps is improved, and the performance of the tubular part is improved.

9 Claims, 6 Drawing Sheets

PREFORMING METHOD FOR HIGH-STRENGTH STEEL VARIABLE-DIAMETER TUBULAR PART

CROSS REFERENCE TO RELATED APPLICATION

This patent application claims the benefit and priority of Chinese Patent Application No. 202210195399.8 filed on Mar. 1, 2022, the disclosure of which is incorporated by reference herein in its entirety as part of the present application.

TECHNICAL FIELD

The present disclosure relates to a preforming method for a high-strength steel variable-diameter tubular part, and belongs to the technical field of metal forming process.

BACKGROUND ART

The high-strength steel has a high mass-strength ratio and an excellent weight reduction effect, so that the high-strength steel is rapidly developed and widely applied in the automobile industry, and the purposes of light weight, high safety and the like of automobiles are achieved. However, when the high-strength steel is used for a tubular part, due to disadvantages of a processing method of the tubular part, the strength of the tubular part cannot be guaranteed. Various tubular parts are arranged on a vehicle body, and the existing metal tubular part is generally processed by the following two methods. The first method is a process route that the high-strength steel tubular part is firstly formed in a soft state and then the high-strength steel tubular part is quenched to improve the strength thereof. In the first method, quenching is conducted outside a mold, so that the heat treatment effect is easy to guarantee, and the defect of deformation caused by quenching cannot be avoided. The second method is a hot air expansion technology, and has the defects that the needed air pressure is too large, the wall thickness of the high-strength steel tubular part is seriously reduced, quenching is not uniform, and the tubular part is cracked, and wrinkling is formed. In the field, those skilled in the art focus on the research direction how to improve the strength of the tubular part.

SUMMARY

To address the defects in the prior art, some embodiments provide a preforming method for a high-strength steel variable-diameter tubular part.

Some embodiments solve the above technical problems through the following technical solution.

The preforming method for a high-strength steel variable-diameter tubular part includes: selecting a tubular blank; and preparing a tubular blank forming mold, where the tubular blank forming mold includes a preforming mold and a final forming mold; sealing and pressurizing the tubular blank; heating the tubular blank by using electrodes; preforming the tubular part at a constant temperature, where performing the tubular part includes heating the tubular blank to a temperature T; enabling the temperature T to be larger than or equal to 300° C., and smaller than or equal to 1200° C.; maintaining the temperature T of the tubular blank for 5-20 s, then closing the preforming mold; compressing the tubular blank; and opening the preforming mold after the tubular blank is compressed; maintaining a temperature T1 and moving the preformed tubular part to the final forming mold, where maintaining the temperature T1 and moving the preformed tubular part to the final forming mold includes continuously maintaining the temperature T1 of the preformed tubular part for 5-20 s, enabling the temperature T1 to be larger than or equal to 700° C., and smaller than or equal to 1300° C., and then moving the preformed tubular part to the final forming mold; and finally forming the tubular part.

The technical solution described above has the advantages as follows. The forming process is divided into a preforming stage and a final forming stage; the circumference of the section of the tubular blank is mainly changed to be equal to that of a final formed tubular part in the preforming process; when the tubular blank is heated to the temperature higher than 0.7 T, the operation for preforming is performed; the required shape of the section of the tubular blank is mainly formed in the final forming stage, and organization conversion is completed in the process. The tubular blank is heated through resistance heat of a metal material thereof, and a pressure in a cavity of the tubular blank automatically rises through the temperature rise of the tubular blank. The temperature T1 of the tubular blank is continuously maintained for 5-20 s, this temperature T1 is larger than or equal to 700° C., and smaller than or equal to 1300° C., and then the tubular blank is moved to the final forming mold. Maintaining the temperature T1 can play two roles: one role is to avoid the temperature drop in the preformed area, and the other role is capable of completing the organization conversion (i.e., the conversion of micro-organization of the high-strength steel).

On the basis of the above technical solution, the inventor makes the following perfections and improvements to the above technical solution.

Further, sealing and pressurizing the tubular blank includes: sealing two ends of the tubular blank, and inflating a cavity of the tubular blank to enable a pressure of the cavity to a pressure P, where the pressure P is larger than or equal to 0.1 MPa and smaller than or equal to 2 MPa. In the process of the present disclosure, a low pressure is selected for pressurization, and the process is convenient to be implemented. Particularly, 0.1-0.8 MPa is mature pneumatic pressure with low cost in engineering, which is successfully applied to the process of the present disclosure.

Further, sealing and pressurizing the tubular blank is performed by using fluid pressurization.

Further, heating the tubular blank by using electrodes includes: connecting two ends of the tubular blank respectively with two of the electrodes of a power supply, and heating the tubular blank by electric current. In the process of the present disclosure, electric heating is used due to a high efficiency of the electric heating. All electric energy is completely converted into heat energy, and the electric energy is directly converted into heat. Compared with traditional in-furnace heating, the efficiency of the electric heating is higher. Due to the fact that in-furnace heating, heat conduction and heat radiation are used for heating, the temperature of the tubular blank is greatly affected by the surface state of the tubular blank. If rust or oil stains exist in some portions on the surface of the tubular blank, the temperature of these portions is different from that of other portions, namely the temperature of a surface area is non-uniform, and subsequent above organization conversion is influenced. In the case of the in-furnace heating by the heat conduction, the temperature is higher at a portion of the furnace which is close to a heat source and the temperature is lower at a portion of the furnace which is away from the heat source. The time for maintaining the temperature needs to be increased to achieve an uniform temperature. Therefore, the in-furnace heating needs to maintain the temperature, but electric heating does not need to maintain the temperature, so that the improvement on the production efficiency is promoted. Compared with the in-furnace heating, in the case of the electric heating, electric energy is directly converted into heat, heat absorption of a wall of the furnace is avoided, the energy utilization rate is higher, and the space is saved. Compared with induction heating, electric heating is more uniform, and particularly the efficiency of the induction heating is greatly reduced after the temperature reaches 700° C.

Further, preforming the tubular part at a constant temperature includes: after the preforming mold is opened, maintaining the pressure for 5-20 s, and unsealing two ends of the tubular blank. The step of preforming the tubular part at a constant temperature is mainly used for austenitization of a steel of the tubular blank. The physical characteristics of dynamic recovery and recrystallization of the steel can be utilized for preforming at the temperature T. The situation that according to traditional preforming (preforming at room temperature or under non-austenitic conditions), the material is strengthened and becomes brittle as the deformation is increased, thereby resulting in preforming failure. Therefore, an unlimited deformation degree can be realized by utilizing the physical property of dynamic recovery and recrystallization.

The technical features described above have the following beneficial effects in some embodiments. The pressure is maintained for 5-20 s, which enables the shape of a compressed part of the tubular blank to achieve contour self-smoothing under the effect of internal pressure.

Further, finally forming the tubular part includes: sealing two ends of the preformed tubular part in a moving process of the preformed tubular part or after the moving process is finished: pressurizing a cavity of the preformed tubular part to enable a pressure of the cavity of the preformed tubular prat to a pressure of 2-20 MPa after the preforming mold begins to be in contact with the preformed tubular part; closing the final forming mold within 10 s, and maintaining the pressure of 2-20 MPa for 5-30 s. Since the circumference of the section of the tubular blank after preforming is already equal to that of the final formed tubular part, only the shape of the section of the tubular blank needs to be changed. The biggest advantage is that a consistent quenching effect along the axial direction of the tubular part is ensured by simultaneous contact of the material with the final forming mold along the axial direction (if the circumference of the section of the tubular blank changes during the final forming stage, a part of the tubular blank with the circumference larger than that of the final formed tubular part can firstly be in contact with the final forming mold, and another part of the tubular blank with the circumference smaller than that of the final formed tubular part can finally be in contact with the final forming mold).

Further, after maintaining the pressure of 2-20 MPa for 5-30 s, the pressure of the cavity of the preformed tubular part is released, the final forming mold is opened to take out the tubular part that is formed, and a cavity of the final forming mold is cleaned by using cooling water or low-temperature high-pressure gas.

Further, the tubular blank forming mold is divided into different sections combined by an upper mold and a lower mold according to radial section shapes and circumferences of different axial sections of the variable-diameter tubular part, and a cavity formed by closing the upper mold and the lower mold is matched with a corresponding one of the axial sections of the tubular part.

The technical features described above have the following beneficial effects in some embodiments. The application sections of the tubular blank are different according to requirements, and the different sections of the tubular blank are required to have different shapes. Therefore, the forming mold also needs to provide a mold cavity having a structure corresponding to the tubular blank.

Further, a side wall of a mold cavity of the lower mold is provided with a straight wall section A, a side wall of a mold cavity of the upper mold is provided with a straight wall section B, and an included angle between the straight wall section A and the straight wall section B is larger than 45°.

The technical features described above have the following beneficial effects in some embodiments. The upper mold and the lower mold are closed to form a preforming mold cavity, and the circumference of the section of the preforming mold cavity is equal to that of the section of the corresponding part of the tubular blank. In order to obtain a large compression amount, the lower mold is provided with a straight wall section A, and the upper mold is provided with a straight wall section B. Further, the straight wall section A is parallel to the opening and closing direction of both the upper mold and the lower mold, and an included angle which is generally larger than 45° is formed between the straight wall section B and the opening and closing direction of the upper mold and the lower mold. In addition, the length of the straight wall section A is larger than two times variation of a perimeter of the section A before and after forming, and the length of the straight wall section B is larger than 10 mm. The effect of the straight wall section A is to make the straight wall tubular blank easier to be compressed than a tubular blank having a curve section. The effect of the straight wall section B is to avoid a circular arc transition at the junction of the straight line section B and the straight line section A.

Reference signs: 1 upper mold; 2 lower mold; 3 straight wall section A; 4 straight wall section B; 10 tubular part; 11 tubular blank; 12 section taken in the A-A direction; 13 section taken in the B-B direction; 13 section taken in the C-C direction.

DETAILED DESCRIPTION OF THE EMBODIMENTS

The following embodiments, in conjunction with the attached figures, are intended only to illustrate the technical solutions recorded in claims and are not intended to limit the protection scope of the claims.

Figure 8:
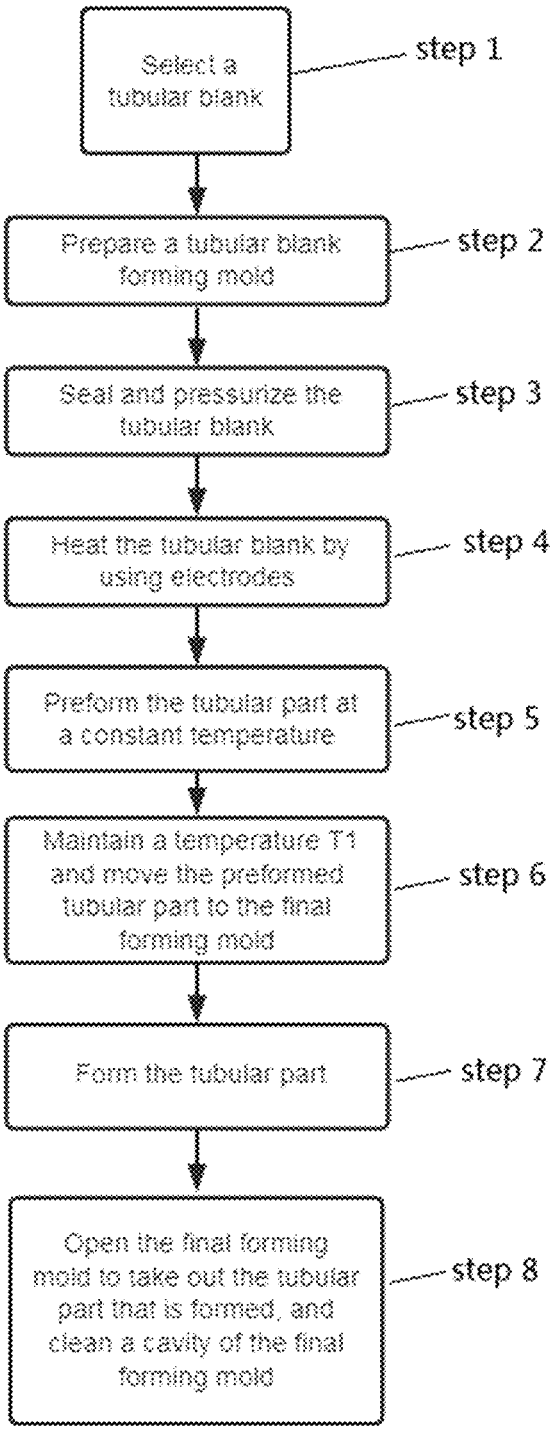
FIG. 8 is a flow chart of a preforming method for a high-strength steel variable-diameter tubular part.
Figure 9:
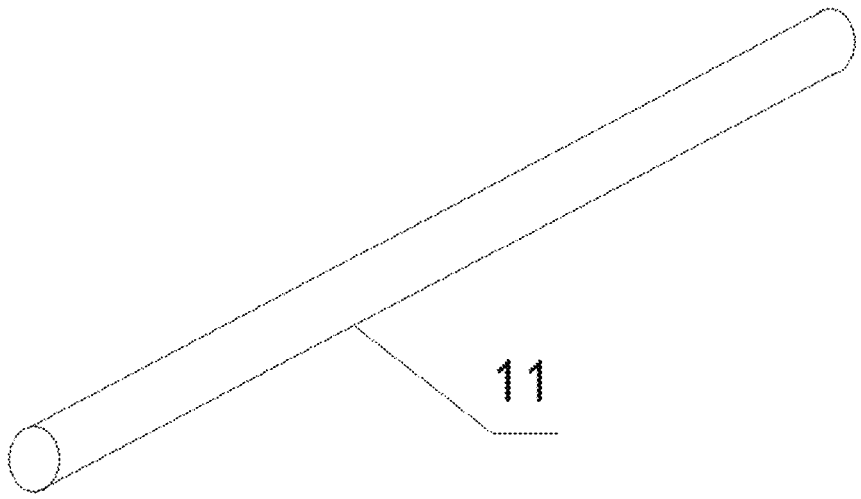
FIG. 9 is a perspective structural schematic diagram of a tubular blank according to an embodiment of the present disclosure.

Referring to FIG. 8, a preforming method for a high-strength steel variable-diameter tubular part includes: selecting a tubular blank 11 in step 1 and preparing a tubular blank forming mold in step 2, where a section of the tubular blank 11 is, for example, circular or elliptical; and the tubular blank forming mold includes a preforming mold and a final forming mold. The preforming mold and the final forming mold are of similar structures, and the structure of an inner cavity of each of the preforming mold and the final forming mold is adaptively adjusted according to the actual structure of a formed tubular part and the requirements in the forming process. The preforming method for a high-strength steel variable-diameter tubular part includes the following steps.

The step 3 of sealing and pressurizing the tubular blank includes: sealing two ends of the tubular blank, and inflating a cavity of the tubular blank to enable a pressure of the cavity to a pressure P, wherein the pressure P is larger than or equal to 0.1 MPa and smaller than or equal to 2 MPa;

The step 4 of heating the tubular blank by using electrodes includes: connecting two ends of the tubular blank respectively with two of the electrodes of a power supply, and heating the tubular blank by electric current;

The step 5 of performing the tubular part includes: heating the tubular blank to a temperature T; enabling the temperature T to be larger than or equal to 300° C., and smaller than or equal to 1200° C.; maintaining the temperature T of the tubular blank for 5-20 s, then closing the preforming mold; compressing the tubular blank; and opening the preforming mold after the tubular blank is compressed;

The step 6 of maintaining a temperature T1 and moving the preformed tubular part to the final forming mold, where maintaining the temperature T1 and moving the preformed tubular part to the final forming mold includes: continuously maintaining the temperature T1 of the preformed tubular part for 5-20 s, enabling the temperature T1 to be larger than or equal to 700° C., and smaller than or equal to 1300° C., and then moving the preformed tubular part to the final forming mold; and The step 7 for final forming; the two ends of the preformed tubular blank are sealed in the moving process thereof or after the moving process thereof is finished, the cavity of the preformed tubular blank is pressurized to the pressure of 2-20 MPa after the final forming mold begins to be in contact with the preformed tubular blank, the final forming mold closes within 10 s, and the pressure of 2-20 MPa is maintained for 5-30 s, and then the pressure of the cavity is released, the final forming mold is opened to take out the formed tubular part, and a cavity of the final forming mold is cleaned by using cooling water or low-temperature high-pressure gas.

Fluid pressurization may be used for pressurizing the sealed cavity of the preformed tubular blank.

Moreover, the step 5 of preforming the tubular part at a constant temperature includes: after the preforming mold is opened, unsealing two ends of the tubular blank.

The tubular blank forming mold is divided into different sections combined by an upper mold and a lower mold according to radial section shapes and circumferences of different axial sections of the variable-diameter tubular part, and a cavity formed by closing the upper mold and the lower mold is matched with a corresponding one of the axial sections of the tubular part. The side wall of the mold cavity of the lower mold is provided with a straight wall section A, the side wall of the mold cavity of the upper mold is provided with a straight wall section B, and the included angle between the straight wall section A and the straight wall section B is larger than 45°.

Hereinafter, a specific tubular part is taken as an example, in order to describe how to process the variable-diameter tubular part in the method in the present disclosure.

Figure 1:
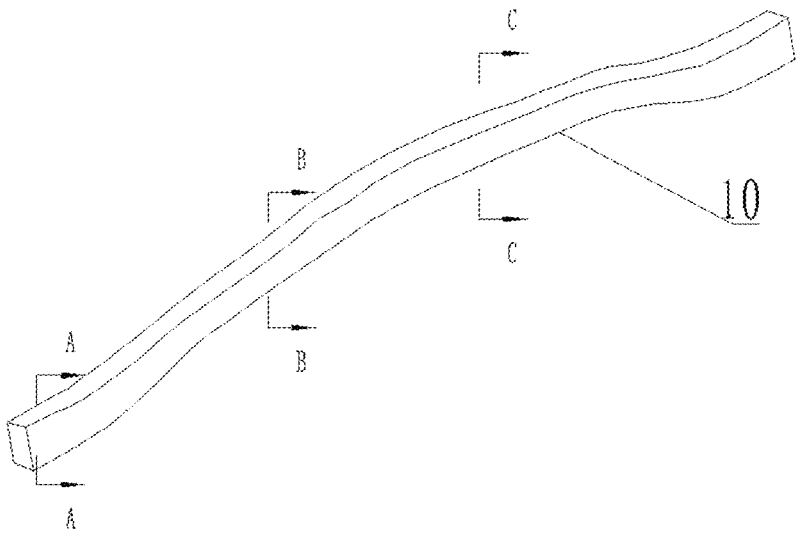
FIG. 1 is a perspective structural schematic diagram of a high-strength steel variable-diameter tubular part according to an embodiment of the present disclosure.
Figure 2:
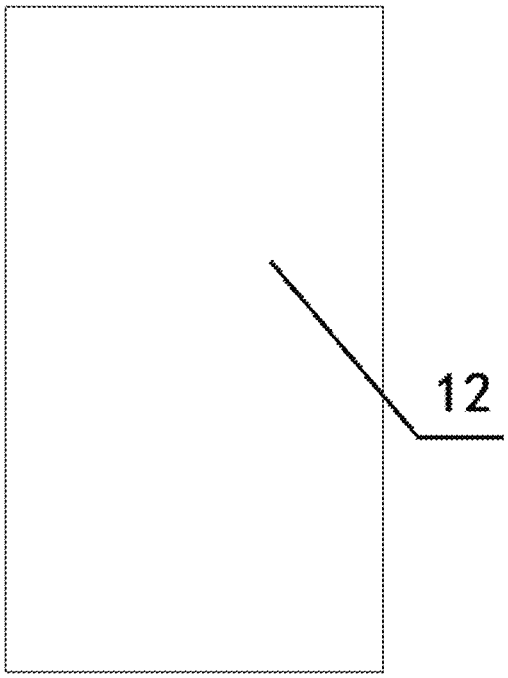
FIG. 2 is a section view taken in the A-A direction in FIG. 1.
Figure 3:
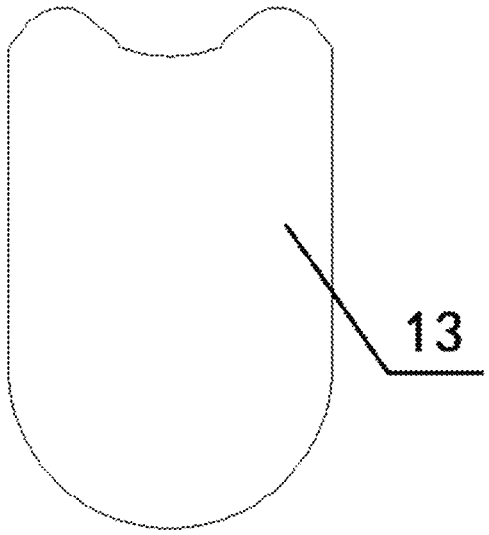
FIG. 3 is a section view taken in the B-B direction in FIG. 1.
Figure 4:
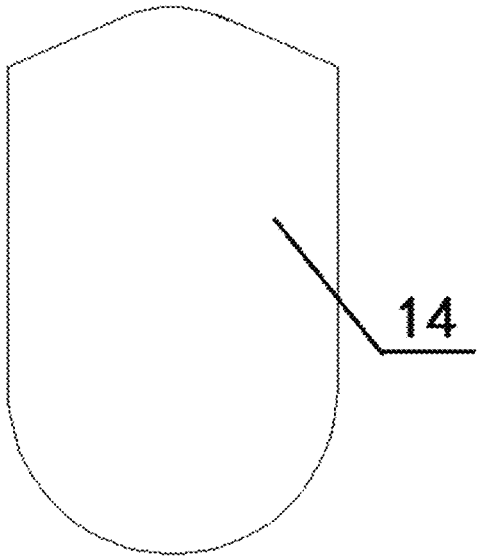
FIG. 4 is a section view taken in the C-C direction in FIG. 1.

The tubular part as shown in FIG. 1 is made of high-strength steel and has three different sections along the axial direction of the tubular part. The sections are different in circumferences and different in shapes. The sections 12-14 as shown in FIG. 2 to FIG. 4 are formed by sectioning the tubular part taken in three directions that are the A-A direction, the B-B direction and C-C direction in FIG. 1, the circumferences of the sections 12-14 in FIG. 2, FIG. 3 and FIG. 4 are indicated by C1, C2 and C0, respectively; and the circumference C1 is larger than the circumference C2 and the circumference C2 is larger than the circumference C0.

The tubular blank 11 is selected, and the section circumferences of all parts of the tubular blank are equal to the circumference C1.

Figure 5:
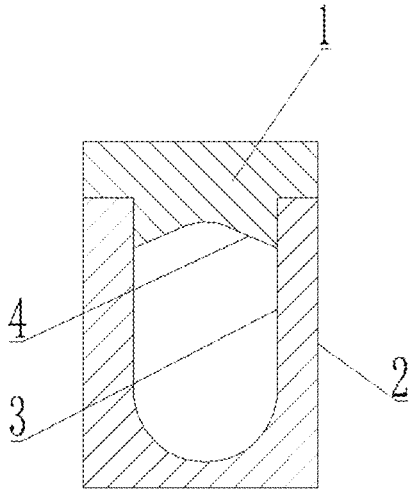
FIG. 5 is a section view of a tubular blank forming mold taken in the C-C direction.

The tubular blank forming mold is prepared, taking a section 14 of the preforming mold, referring to FIG. 5, taken in the C-C direction as an example, the section 14 of the preforming mold is divided into an upper mold 1 and a lower mold 2. The upper mold 1 and the lower mold 2 are closed to form a cavity of a preforming mold, and the circumference of the section 14 of the cavity is equal to that taken in the C-C direction. In order to obtain a large compression amount, the lower mold is provided with a straight wall section A 3, the upper mold is provided with a straight wall section B 4, the straight wall section A 3 is parallel to the opening and closing direction of the upper mold and the lower mold, and an included angle which is generally larger than 45° is formed between the straight wall section B 4 and the opening and closing direction of the upper mold and the lower mold; and the length of the straight wall section A 3 is larger than two times the section variation, and the length of the straight wall section B 4 is larger than 10 mm. The movement of the preforming molds at different sections is generally relatively independent, and the preforming molds can be opened and closed along respective opening and closing directions thereof, so that compression in different directions on the sections is realized. For example, the opening and closing directions at the section 12 taken in the A-A direction is the vertical direction, and the opening and closing directions at the section 13 taken in the B-B direction is the horizontal direction. That the finally formed part moves along which one of the above directions is based on the specific needs at the respective section of the finally formed part.

In the step 3, the two ends of the tubular blank 11 are sealed, the pressure of the cavity of the tubular blank 11 is inflated to the pressure P, and the pressure P is larger than or equal to 0.1 MPa and smaller than or equal to 2 MPa.

In the step 4, the two ends of the tubular blank 11 are respectively connected with two electrodes of a power supply, and the tubular part is heated by the electric current.

In the step 5, after the tubular blank 11 is heated to the temperature T, the temperature T is larger than or equal to 300° C., and smaller than or equal to 1200° C., and the temperature T of the tubular blank 11 is maintained for 5-20 s, then the preforming mold is closed, and the circumference of the corresponding section of the tubular blank 11 is compressed. The material is easy to be compressed at a high temperature, the interior of the tubular blank is supported by the air with the pressure P, and the air pressure is increased during the process of maintaining the temperature T under the influence of the temperature rise of the tubular blank, so that wrinkling caused when the circumference is compressed is avoided. By utilizing the preforming mold, the circumference of the section 12 taken in the A-A direction is compressed into the circumference C1, and the circumference of the section 13 taken in the B-B direction is compressed into the circumference C2. The unsealing is performed, the internal pressure is released, and the preforming mold is opened.

In the step 6, the temperature T1 of the tubular blank 11 is continuously maintained for 5-20 s, the temperature T1 is larger than or equal to 700° C., and smaller than or equal to 1300° C., and then the tubular blank is moved to the final forming mold. The functions realized by maintaining the temperature T1 are as follows. One function is to avoid the temperature drop in the preformed area, and the other function is capable of completing the austenitization conversion.

Figure 6:
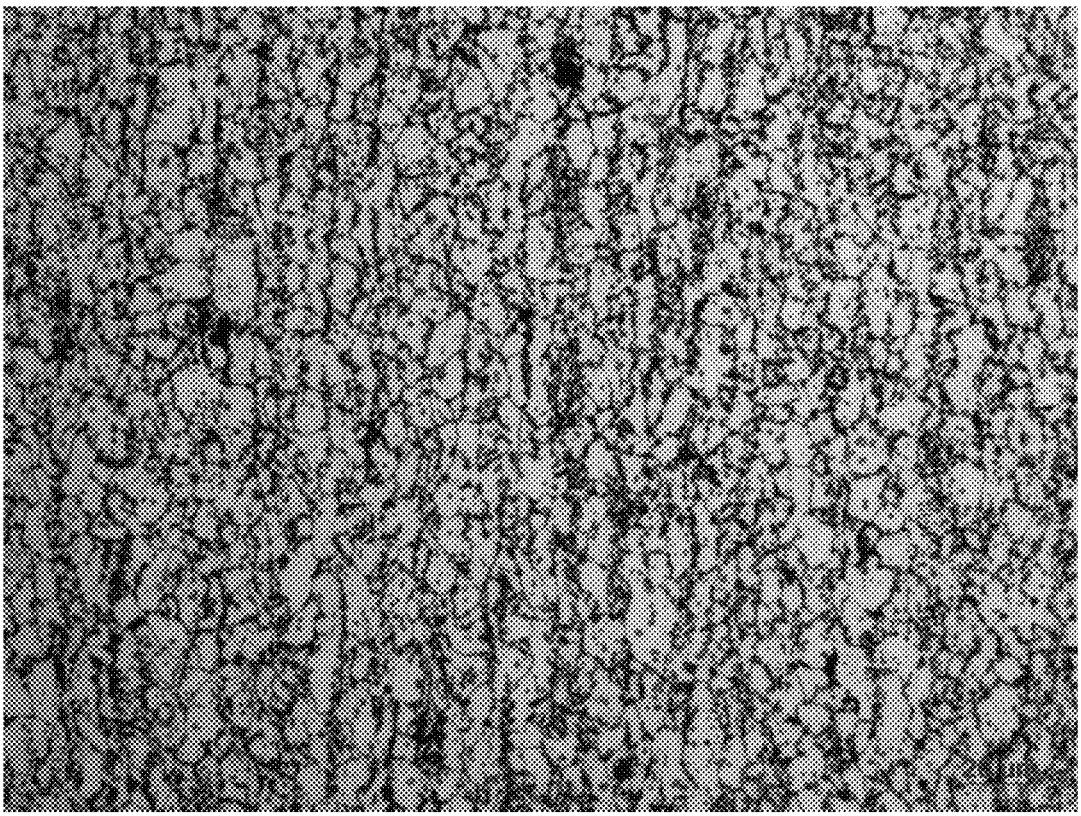
FIG. 6 is a metallographical photograph before organization conversion of a tubular blank.
Figure 7:
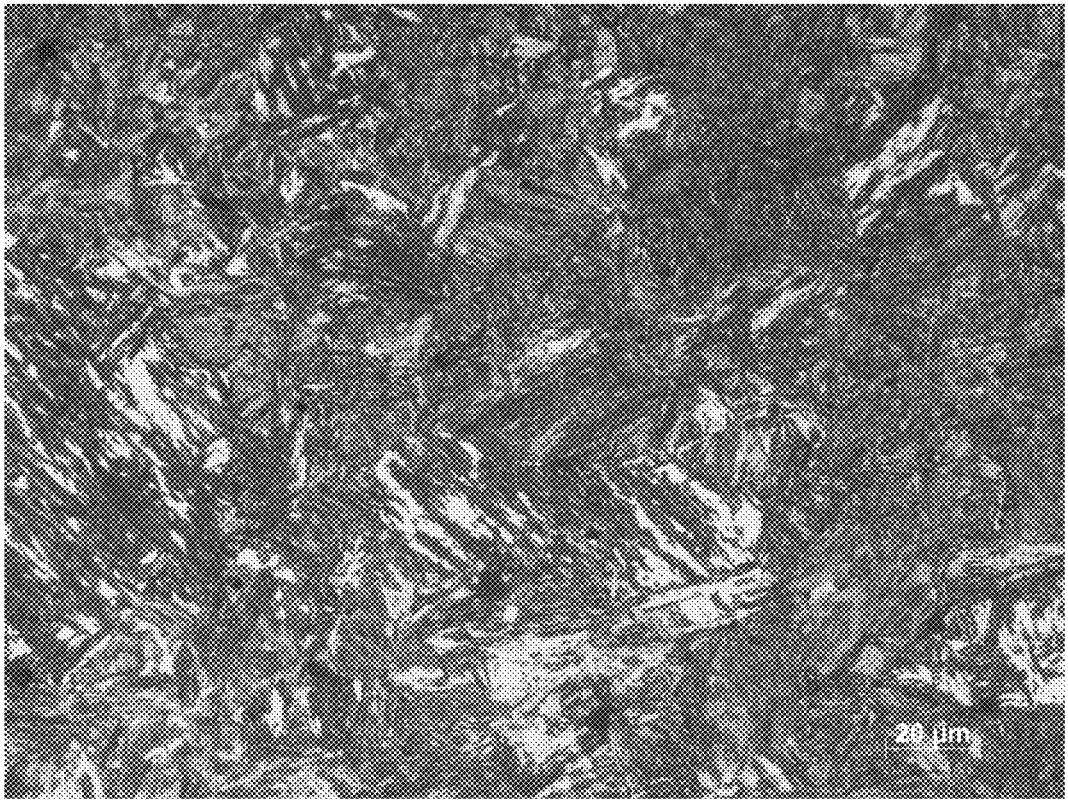
FIG. 7 is a metallographical photograph after the organization conversion of a tubular blank.

In the step 7, the final forming of the preformed tubular blank is conducted. The cavity of the final forming mold is the same as that of the tubular part. The ends of the preformed tubular part are sealed in the moving process of the preformed tubular part or after the moving process thereof is finished, the pressure of the cavity of the preformed tubular part is pressurized to the pressure of 2-20 MPa after the final forming mold begins to be in contact with the preformed tubular part, the final forming mold is closed within 10 s, and the pressure of 2-20 MPa is maintained for 5-30 s, so that martensite conversion is completed. FIG. 6 illustrates ferrite with very soft property and pearlites with relatively soft property in the original structures. FIG. 7 illustrates martensite with high hardness converted after being formed. So, after the tubular part is formed, the strength of the part can reach more than 1400 MPa from original 400 MPa.

In the step 8, the pressure of the cavity of the preformed tubular part is released, the final forming mold is opened to take out the formed tubular part, and the cavity of the final forming mold is cleaned by using cooling water or low-temperature high-pressure gas.

The foregoing descriptions are merely exemplary embodiments of the present disclosure, and are not intended to limit the present disclosure. Any modification, equivalent replacement, or improvement made within the spirit and principle of the present disclosure shall fall within the protection scope of the present disclosure.

What is claimed is:

1. A preforming method for a high-strength steel variable-diameter tubular part, comprising:

selecting a tubular blank; and preparing a tubular blank forming mold, wherein the tubular blank forming mold comprises a preforming mold and a final forming mold;

sealing and pressurizing the tubular blank;

heating the tubular blank by using electrodes;

preforming the tubular part at a constant temperature, wherein performing the tubular part comprises heating the tubular blank to a temperature T; enabling the temperature T to be larger than or equal to 300° C., and smaller than or equal to 1200° C.; maintaining the temperature T of the tubular blank for 5-20 s, then closing the preforming mold; compressing the tubular blank; and opening the preforming mold after the tubular blank is compressed;

maintaining a temperature T1 and moving the preformed tubular part to the final forming mold, wherein maintaining the temperature T1 and moving the preformed tubular part to the final forming mold comprises continuously maintaining the temperature T1 of the preformed tubular part for 5-20 s, enabling the temperature T1 to be larger than or equal to 700° C., and smaller than or equal to 1300° C., and then moving the preformed tubular part to the final forming mold; and finally forming the tubular part.

2. The preforming method for a high-strength steel variable-diameter tubular part according to claim 1, wherein sealing and pressurizing the tubular blank comprises: sealing two ends of the tubular blank, and inflating a cavity of the tubular blank to enable a pressure of the cavity to a pressure P, wherein the pressure P is larger than or equal to 0.1 MPa and smaller than or equal to 2 MPa.

3. The preforming method for a high-strength steel variable-diameter tubular part according to claim 2, wherein, sealing and pressurizing the tubular blank is performed by using fluid pressurization.

4. The preforming method for a high-strength steel variable-diameter tubular part according to claim 1, wherein, heating the tubular blank by using electrodes comprises: connecting two ends of the tubular blank respectively with two of the electrodes of a power supply, and heating the tubular blank by electric current.

5. The preforming method for a high-strength steel variable-diameter tubular part according to claim 1, wherein, preforming the tubular part at a constant temperature comprises: after the preforming mold is opened, unsealing two ends of the tubular blank.

6. The preforming method for a high-strength steel variable-diameter tubular part according to claim 1, wherein, finally forming the tubular part comprises: sealing two ends of the preformed tubular part in a moving process of the preformed tubular part or after the moving process is finished; pressurizing a cavity of the preformed tubular part to enable a pressure of the cavity of the preformed tubular part to a pressure of 2-20 MPa after the preforming mold begins to be in contact with the preformed tubular part; closing the final forming mold within 10 s, and maintaining the pressure of 2-20 MPa for 5-30 s.

7. The preforming method for a high-strength steel variable-diameter tubular part according to claim 6, wherein, after maintaining the pressure of 2-20 MPa for 5-30 s, releasing the pressure of the cavity of the preformed tubular part, opening the final forming mold to take out the tubular part that is formed, and cleaning a cavity of the final forming mold by using cooling water or low-temperature high-pressure gas.

8. The preforming method for a high-strength steel variable-diameter tubular part according to claim 1, wherein, dividing the tubular blank forming mold into different sections combined by an upper mold and a lower mold according to radial section shapes and circumferences of different axial sections of the variable-diameter tubular part, and matching a cavity formed by closing the upper mold and the lower mold with a corresponding one of the axial sections of the tubular part.

9. The preforming method for a high-strength steel variable-diameter tubular part according to claim 8, wherein, a side wall of a mold cavity of the lower mold is provided with a straight wall section A, a side wall of a mold cavity of the upper mold is provided with a straight wall section B, and an included angle between the straight wall section A and the straight wall section B is larger than 45°.

* * * * *